United States Patent [19]

Hallock

[11] Patent Number: 4,610,188

[45] Date of Patent: Sep. 9, 1986

[54] MAGNETIC DRIVING TOOL

[76] Inventor: Peter Hallock, 234 Seaview Ave., Swansea, Mass. 02777

[21] Appl. No.: 469,339

[22] Filed: Feb. 24, 1983

[51] Int. Cl.[4] ..... B25D 1/04

[52] U.S. Cl. ..... 81/24; 227/113; 173/126

[58] Field of Search ..... 145/30 A, 30 R; 227/146, 147, 113; 125/40, 41; 81/DIG. 12, 52.13, 24, 436, 460, 461; 173/137, 128, 90, 126; 335/209; 7/143, 901, 149, 30 R

[56] References Cited

U.S. PATENT DOCUMENTS

| | | | |
|---|---|---|---|
| 352,070 | 11/1886 | Robertson | 145/30 A |
| 411,633 | 9/1889 | Balfour | 145/30 R |
| 509,399 | 11/1893 | Richardson | 145/30 R |
| 2,258,861 | 10/1941 | Park et al. | 227/147 |
| 2,450,185 | 9/1948 | Craven | 173/93 |
| 2,864,417 | 12/1958 | Scholten | 143/30 R |
| 3,253,626 | 5/1966 | Stillwagon, Jr. et al. | 81/460 |
| 3,403,738 | 10/1968 | Burkhart et al. | 81/57.3 |
| 3,696,693 | 10/1972 | Bosten et al. | 173/93 |

*Primary Examiner*—Donald R. Schran
*Assistant Examiner*—James L. Wolfe
*Attorney, Agent, or Firm*—Dowell & Dowell

[57] ABSTRACT

A tool for driving metallic fasteners which includes a magnetic driving head defined by partially separated segments of opposite polarity which are spaced from one another along a portion of their width, but which are integrally connected by an integrally formed reinforcing bridge element so that the impacting surface of the tool is generally continuous except for spaced grooves which extend inwardly of the impacting surface of the tool and which partially separate the magnetized segments from one another.

6 Claims, 6 Drawing Figures

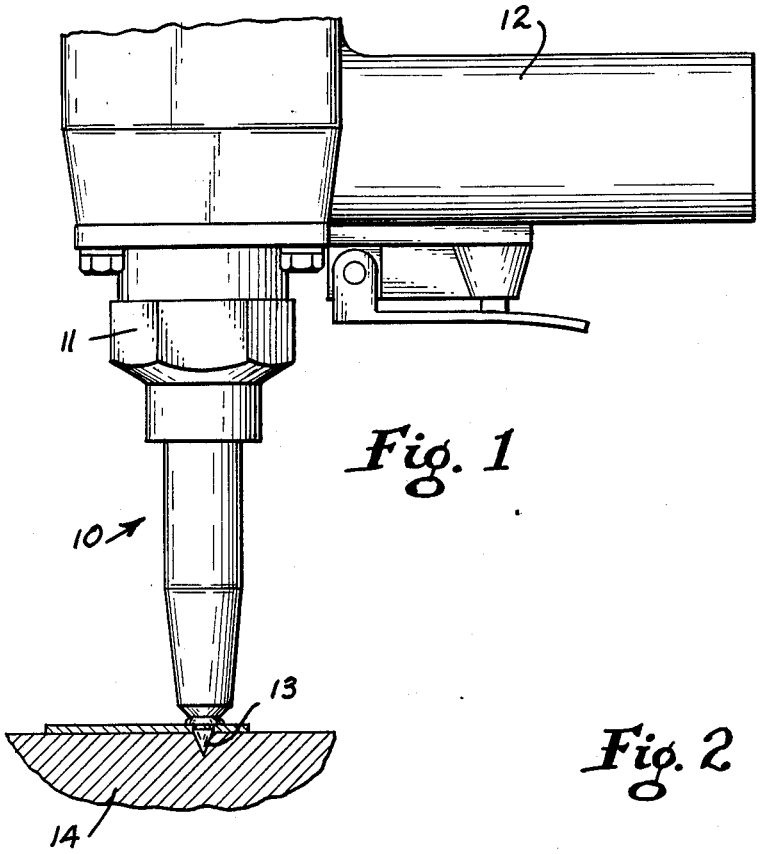
Fig. 1
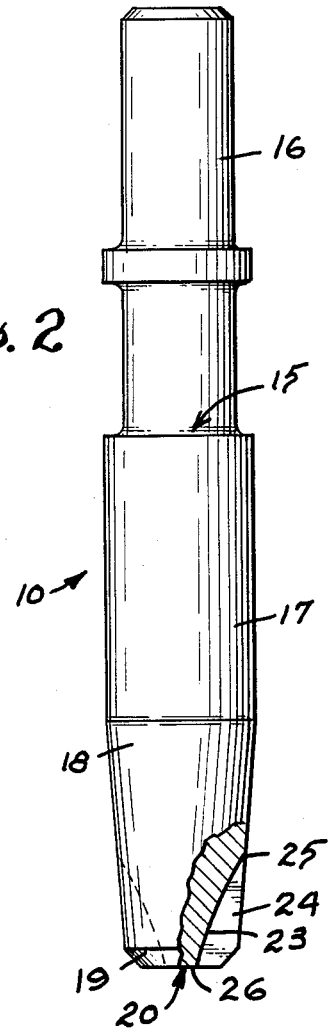
Fig. 2
Fig. 3
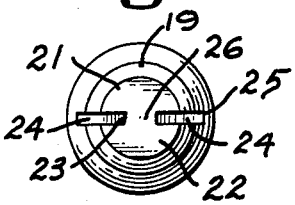
Fig. 4
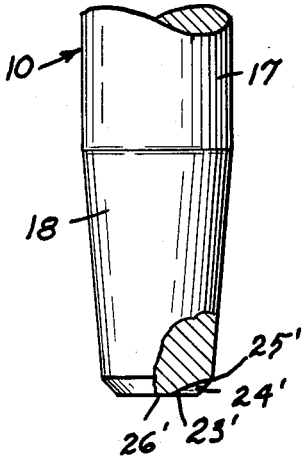
Fig. 5
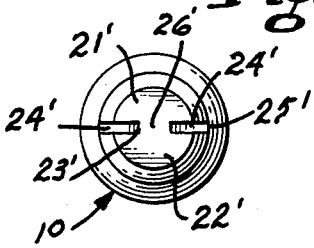
Fig. 6
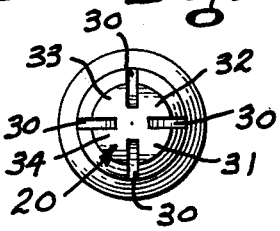

MAGNETIC DRIVING TOOL

TECHNICAL FIELD

This invention is generally related to tools for driving metallic fasteners and particularly to a tool having an integrally formed driving head which has at least one pair of grooves provided therein which extend from the impacting surface of the tool and flare outwardly along their length to thereby separate the impacting surface of the tool into partially separated segments which are joined by an integral bridge element. The partially separated impacting segments are magnetized having opposite polarity so that the impacting surface of the tool will attract and support metallic fasteners. The integral bridge element reinforces and distributes the impact force along the driving head of the tool.

BACKGROUND OF THE INVENTION

The use of magnetized fasteners and similar impacting tools is well known. Such tools offer the advantages of supporting the fastener being driven so that the fastener need not be steadied or supported relative to a working surface by manual or other means. The use of magnetic impacting tools is especially beneficial when the fasteners to be driven are relatively small and thus not easily supported or aligned by manual means.

Magnetized driving tools not only include hand held hammers, but also include power tool drivers which may be selectively used with pneumatic hammers. Prior to the present development, magnetic drivers used with power tools have had limited operating life expectancies especially in work environments where the tool is being used to drive metallic fasteners into metal surfaces. Conventional magnetic drivers used with power hammers have been manufactured having a driving head which is defined by splitting the impacting surface into two completely separate segments which are oppositely polarized. The segments are spaced from one another by a continuous groove. During use, however, it has been found that the tool impacting surface or a portion of the head adjacent the groove will chip or break after limited usage, as for example, 7,000 to 8,000 impacts. This breakage or failure of the tool apparently occurs due to movement of the spaced impacting segments relative to one another during use.

Attempts have been made to cushion the driving head of magnetic power hammers by filling the slots or openings between the segmented driving surface with various nonmagnetic compounds of plastic or rubber material, however, the driving heads continued to split or fracture after limited use.

DISCLOSURE OF THE INVENTION

The present invention is embodied in a magnetic driving tool which can be used with pneumatic power hammers and includes an integrally formed shank having a mounting or base portion and a driving head. A pair of grooves or slots are cut into the end of the driving head thereby dividing the impacting portion of the head into two spaced impacting segments which are joined by an integral bridge member. The slots are cut so as to flare outwardly towards the surface of the shank as the slots extend from the impacting surface or end of the driving head. As a result of the tapered slots, the bridge member defined therebetween becomes increasingly wider from the impacting surface toward the portion of the driving head at which the slots terminate.

The separate impacting segments are magnetized having opposite polarity to thereby enable the impacting surface to attract and retain metallic fasteners which are to be driven using the power hammer.

In another embodiment of the invention, the end of the driving head of the tool is provided with two or more pairs of spaced slots which divide the end of the driving head into an even number of impacting segments. The slots are formed as in the preferred embodiment and the impacting segments are alternately magnetized having opposite polarity.

It is the primary object of this invention to provide a magnetic driving tool which is constructed to permit the tool to be used for high energy impact fastener driving with an increased life expectancy over conventional magnetic driving tools.

It is another object of this invention to provide a magentic driving tool which is formed and designed to permit the driving area of the tool to be integrally reinforced while still permitting sufficient magnetic properties to be retained and exhibited by the oppositely polarized impacting surface segments of the tool to permit its use for driving small metallic fasteners.

It is another object of this invention to provide a magnetic driving tool which can be used with a power hammer to deliver in excess of 50,000 impacts without failure or fracturing.

BRIEF DESCRIPTION OF THE DRAWINGS

FIG. 1 is an illustration of the invention as used in driving a metallic fastener into a metallic base material.

FIG. 2 is a front elevated view of the invention having a portion of the area of the head broken away for clarity.

FIG. 3 is a bottom plan view showing the impacting surface of the invention.

FIG. 4 is a partial front elevational view of a modified form of the invention having a portion broken away for clarity.

FIG. 5 is a bottom plan view showing the impacting surface of the modified form of the invention shown in FIG. 4.

FIG. 6 is a bottom plan view showing another modified form of the invention in which four impacting surface segments are shown.

DESCRIPTION OF THE PREFERRED EMBODIMENT

With continued reference to the drawings, the magnetic driving tool 10 of the present invention is shown as it is normally mounted for use in the chuck 11 of a conventional pneumatic power hammer 12. The magnetic driving tool functions to support a metallic fastener 13 so that when the fastener is aligned with the material 14 into which the fastener is to be driven, actuation of the pneumatic hammer will cause the magnetic tool to drive the fastener into the material as shown in FIG. 1.

The magnetic driving tool 12 includes an elongated shank 15 having a chuck mounting or engaging portion 16, intermediate body portion 17, and tapered head portion 18. The end of the head portion may be bevelled as shown at 19 toward the impacting surface or end 20 of the tool.

With particular reference to FIGS. 2 and 3, the impacting end of the tool is partially and substantially uniformally separated into a pair of spaced impacting segments 21 and 22 which are integrally joined adjacent the central portion of the impacting surface or end by an intermediate bridge member or section 23 by a pair of grooves 24. The grooves 24 are cut or formed into opposite sides of the impacting end of the head portion 18 of the tool shank and are formed so as to be of increasingly greater depth as they extend toward the impacting surface as shown in the partial section of FIG. 2.

The impacting segments 21 and 22 are magnetized so as to be of opposite polarity, segment 21 being the magnetic north pole and segment 22 being the magnetic south pole. Despite the fact that the impacting segments are integrally joined by the bridge member 23, such segments may be sufficiently magnetized to retain small metallic fasteners which are to be driven using the driving tool. Further, the bridge member functions to reinforce or strengthen the impacting segments and thereby prevents such segments of the tool from fracturing after limited usage.

The bridge member is shown as being somewhat wedge shaped being broader at its base 25, the point at which the grooves terminate along the driving portion of the tool, and narrow at the tip 26 which defines a portion of the impacting end of the tool. The integral bridge member not only strengthens the magnetized impacting segments 21 and 22 and resists any tendency of the segment to move relative to one another, but also distributes the impact stress across the full width of the driving head at the base 25 of the bridge member.

By way of example, a suitable driving tool has been manufactured using a D-2 steel having an overall length of approximately 3.188 inches and a maximum diameter along the intermediate portion of the shank of 0.500 inch. The head portion of the tool was formed having a length of approximately 0.813 inch which includes approximately 0.062 inch defining the bevelled end wall portion 19 leading to the impacting surface 20. Although the maximum diameter of the tool is 0.500 inch the impacting surface was constructed having a diameter of 0.260 inch. The grooves 24 were cut having a width of 0.020 inch, and were made so as to create a bridge member having a minimum width of 0.095 inch between the grooves measured at the impacting surface 20. The grooves were made on an arc flaring outwardly to the surface of the head portion of the tool at a point 25 remote from the impacting surface. The impacting segments 21 and 22 were thereafter magentized having opposite polarities.

With respect to FIGS. 4 and 5 of the drawings, there is disclosed a modified form of the invention in which the grooves formed in the head portion of the tool are cut or extend to a lesser depth than shown in FIGS. 2 and 3. Specifically, as shown in FIG. 4, the grooves separate the impacting end into two separate surface segments 21' and 22' which are interconnected by an integral bridge member 23'. Bridge member 23' is substantially the same width, as defined between the grooves, as the width of the bridge member 23 shown in FIG. 3 with respect to the preferred embodiment. The grooves 24', however, flare outwardly and terminate at the base of the bridge member 25' adjacent the tapered end portion 10 of the head of the tool as opposed to extending midway along the length of the head portion as shown with respect to the preferred embodiment. It has been found that sufficient magnetization of the spaced segments 21' and 22' of the modified form of the invention can be achieved to permit the tool to be used with various small metallic fasteners.

Although the structure of the magnetic driving tool has only been described as having a pair of grooves or slots which partially divide the end of the head portion into two impacting segments, it is possible that the end of the tool be divided into a plurality of even numbered segments. With particular reference to FIG. 6, two pair of substantially equally spaced grooves 30 are shown as dividing the impacting end 20 of the tool into four partially separated or spaced impacting segments 31, 32, 33 and 34. Each of the grooves is cut or made as described with respect to the embodiment shown in FIGS. 1–3, or FIGS. 4 and 5 and thereby create a bridge member 35 which integrally connects all of the impacting segments. The impacting segments may subsequently be magnetized having alternating opposite polarities whereby each segment magnetized as a south pole is separated on each side by a segment magnetized as a north pole of a magnet.

It should be noted that the impacting end of the tool may be divided even further, however, such additional segmenting of the impacting tool would probably only be considered if the size (diameter) of the impacting end is increased. Further, in order to maintain sufficient magnetic attraction, the impacting segments should include an equal number of oppositely polarized segments which are oriented with respect to one another so as to provide for an optimum magnetic attraction.

In use the mounting portion of the tool is received within the chuck of a pneumatic hammer and thereafter secured in place. A metallic fastener, such as that shown in FIG. 1 of the drawings, is attracted by the magnetized impacting segments of the tool and thereby retained for alignment with respect to the surface into which the fastener is to be driven. Upon actuation of the pneumatic hammer the driving tool drives the metallic fastener into the working surface. Although the driving tool of the present invention has particular utility in driving especially designed metallic fasteners into metallic surfaces using power actuated hammers, the integrally impacted magnetic surface segmenting of the driving end of a tool could be incorporated with the design and structure of conventional hand operated hammers. The integral bridge concept also enables stresses to be distributed along the total width of the driving head of the tool and simultaneously reinforces and strengthens the impacting segments of the tool.

I claim:

1. A magnetic hammer tool for attracting the head of a metallic fastener during driving comprising a shank having a mounting portion and a driving end portion, said driving end portion having first and second impacting segments, said first and second impacting segments having generally planar impact surfaces, a pair of oppositely disposed grooves partially separating said first and second impacting segments and extending from said impact surfaces along a portion of the length of said driving end portion, a bridge section defined between said grooves integrally connecting said first and second impacting segments, said bridge section having an impact surface which is generally coextensive with said first and second impact surfaces of said first and second impacting segments, the material of said first and second impacting segments of said tool being magnetized having opposite polarities, whereby the impacting surface of the tool will retain metallic fasteners during the use of the tool.

2. The driving tool of claim 1 in which said grooves flare outwardly along their length from said impacting surfaces of said first and second impact segments and terminating along the length of said driving end portion of said tool, said bridge member increasing in width from adjacent said impact surfaces of said first and second impact segments to the point at which said slots terminate.

3. The driving tool of claim 2 in which said bridge member is generally in the shape of a frustum of a wedge.

4. A magnetic hammer tool for attracting the head of a metallic fastener during driving comprising a shank having a mounting portion and a driving end portion, said driving end portion having at least one pair of impacting segments, said impacting segments having generally planar impact surfaces, at least one pair of oppositely disposed grooves partially separating said impacting segments from one another and extending from said impact surfaces along a portion of the length of said driving end portion, a bridge section defined between said grooves integrally connecting said impacting segments, said bridge section having an impact surface which is generally coextensive with said impact surfaces of said impacting segments, the material of said impacting segments of said tool being magnetized having opposite polarities whereby the impacting surface of the tool will retain metallic fasteners during the use of the tool.

5. The driving tool of claim 4 in which said grooves flare outwardly along their length from said impacting surfaces of said impact segments and terminating along the length of said driving end portion of said tool, said bridge member increasing in width from adjacent said impact surfaces of said impact segments to the point at which said slots terminate.

6. The driving tool of claim 4 in which said impacting segments are substantially equal in size and each of said impacting segments is spaced from an impacting segment of the same magnetic polarity by an impacting segment of the opposite polarity.

* * * * *